United States Patent [19]

Nakai

[11] 4,282,463

[45] Aug. 4, 1981

[54] MAGNETRON WITH CONTINUOUS MAGNETIC CIRCUIT

[75] Inventor: Kaichiro Nakai, Yokohama, Japan

[73] Assignee: Tokyo Shibaura Denki Kabushiki Kaisha, Kawasaki, Japan

[21] Appl. No.: 81,788

[22] Filed: Oct. 4, 1979

[30] Foreign Application Priority Data

Oct. 16, 1978 [JP] Japan ..... 53/141702[U]

[51] Int. Cl.[3] ..... H01J 25/50

[52] U.S. Cl. ..... 315/39.71; 315/39.53; 315/39.75

[58] Field of Search ..... 315/39.51, 39.53, 39.75, 315/39.71

[56] References Cited

U.S. PATENT DOCUMENTS

| | | | |
|---|---|---|---|
| 3,846,667 | 11/1974 | Hisada et al. | 315/39.53 |
| 3,967,087 | 6/1976 | Kanuma | 315/39.51 |
| 4,044,279 | 8/1977 | Tsuzurahara et al. | 315/39.53 |
| 4,163,175 | 7/1979 | Tashiro | 315/39.51 |
| 4,164,684 | 8/1979 | Oguro | 315/39.51 |
| 4,166,235 | 8/1979 | Yamashita et al. | 315/39.51 |

*Primary Examiner*—Saxfield Chatmon, Jr.
*Attorney, Agent, or Firm*—Schuyler, Banner, Birch, McKie & Beckett

[57] ABSTRACT

In a magnetron comprising a cylindrical anode, a cathode positioned coaxially in the anode, an output portion extending from the anode, an annular magnet, a yoke having a larger diameter opening extended through by the output portion, and a gasket a magnetic shim plate is provided between the permanent magnet and the yoke so that the entire surface of the permanent magnet is in magnetic contact with the yoke. A continuous magnetic circuit is thereby formed to prevent the formation of any gaps to avoid fluctuations or reduction in the magnetic flux.

9 Claims, 12 Drawing Figures

FIG. 5
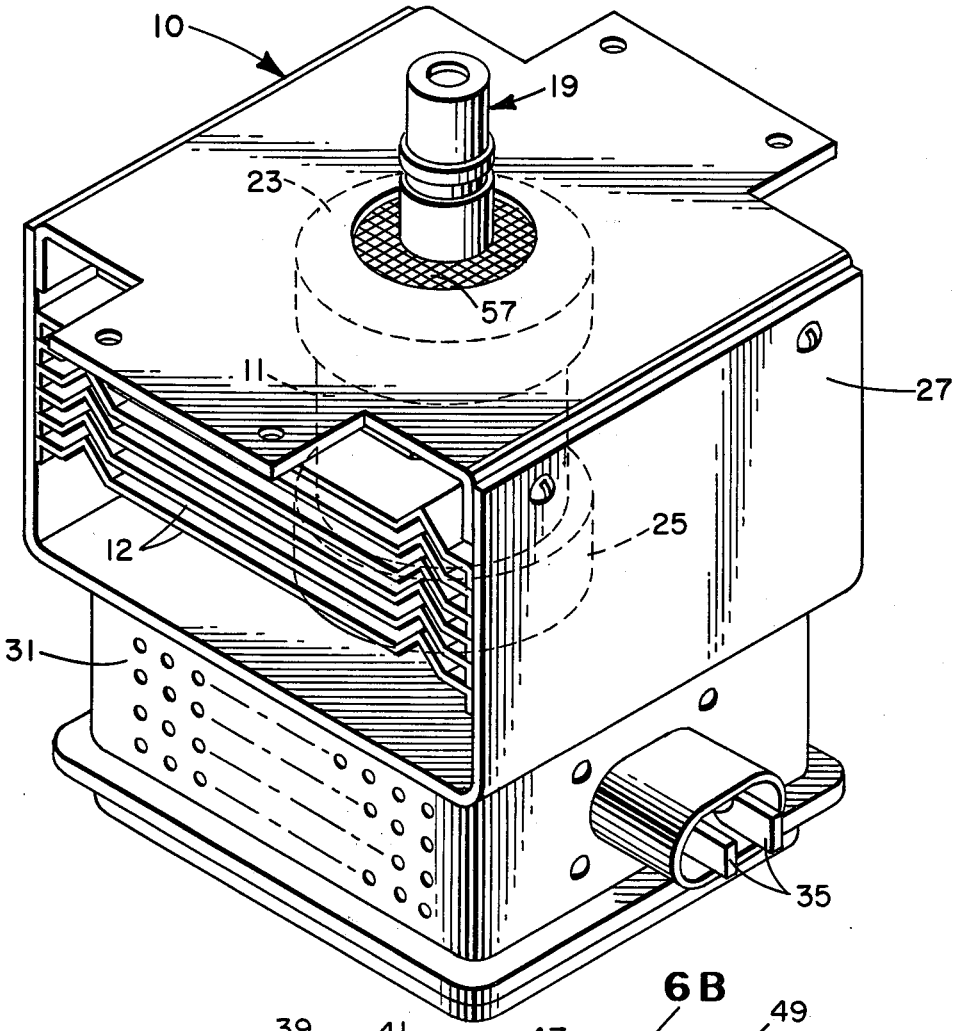
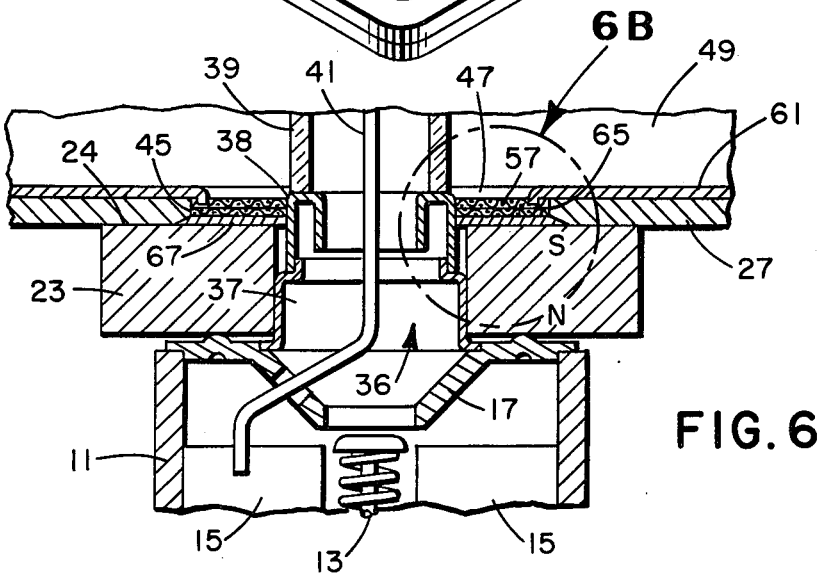
FIG. 6A

MAGNETRON WITH CONTINUOUS MAGNETIC CIRCUIT

BACKGROUND OF THE INVENTION

This invention relates to a magnetron, more particularly to a magnetic contacting structure between a magnet and a yoke.

A magnetron is used generally as the power source of a microwave oven or a radar system. Microwave power is supplied to the oven or the radar system through an opening in an oven wall or a wave guide connected to the magnetron. The size of the opening in existing microwave ovens and radar systems has been large because of the large size of conventional magnetrons.

In recent years, the magnetron has been miniaturized for use in microwave ovens without reduction of performance. However, the opening in many microwave ovens remains large compared with the small size of the miniaturized magnetrons. In this latter case, as generally known in the art, a gasket is positioned between the opening of the oven and the magnetron to adjust for the large size of the opening. The gasket electrically connects the magnetron anode to the opening of the oven.

An internal magnet type magnetron has annular ferrite magnets at both sides of the magnetron anode, i.e., magnets are positioned adjacent output and input portions. A yoke, which together with the magnets forms a magnetic circuit, surrounds the magnets and the anode. The output portion of the magnetron extends through an opening in the annular magnet and an opening in the yoke. The diameter of the opening of the magnet is substantially equal to the output portion diameter, while the diameter of the yoke opening is larger than the diameter of the opening of the magnet. As known in the art, the gasket is positioned in the yoke opening adjacent the magnet. The yoke opening is also slightly larger than the opening of the oven so that the portion of the oven which forms the oven can be connected to the gasket.

Several disadvantages result from the conventional techniques of using a miniaturized magnetron in a microwave oven. For example, when the outer diameter of the magnet is reduced by miniaturizing the magnetron, the contact area of the magnet and the yoke is reduced. As a result, the magnetic flux from the magnet passing through the yoke is reduced. Further more, the magentic flux can fluctuate due to the magnetic or nonmagnetic walls of the oven.

Finally, in U.S. Pat. No. 4,044,279 issued to Tsuzurahara on Aug. 23, 1977, an annular conductive washer is placed between the gasket and the magnet in order to prevent the loss of microwave power. However, a disadvantage of this conventional technique is that an air gap is formed between the yoke and the magnet. The air gap causes a reduction in the magnetic conductance of the magnetic circuit of the magnetron.

SUMMARY OF THE INVENTION

It is an object of this invention to provide a magnetron having an effective magnetic circuit which overcomes the above described disadvantages of the conventional techniques.

It is a further object of this invention to provide a magnetron having a magnetic circuit which is not influenced by the outer device to which it is connected, such as the frame of the oven.

According to one aspect of this invention, a magnetron is provided comprising a cylindrical anode having a plurality of vanes forming anode cavities, a cathode positioned coaxially in the anode and an output portion. The output portion comprises a metal cylinder extending from the anode, a cylindrical insulator extending from the metal cylinder and an antenna lead extending through the metal cylinder and the cylindrical insulator. The output portion extends through a permanent magnet. A yoke, which has an opening through which the output portion extends, forms a magnetic circuit with the magnet. The openng of the yoke has a diameter between the inner and outer diameters of the magnet and substantially equal to or greater than the center diameter of the magnet. A gasket is positioned in the opening. A magnetic shim plate then is positioned between the magnet and the yoke so that the whole surface of the magnet facing the yoke makes magnetic contact with the yoke.

BRIEF DESCRIPTION OF THE DRAWINGS

FIG. 5 is a perspective view of the magnetron show in FIG. 1.

FIGS. 6A and 6B are sectional views of the main portion of a second embodiment of this invention. FIG. 6B being an enlargement of a part of FIG. 6A marked by arrow B.

DETAILED DESCRIPTION OF THE PREFERRED EMBODIMENT

Figure 1:
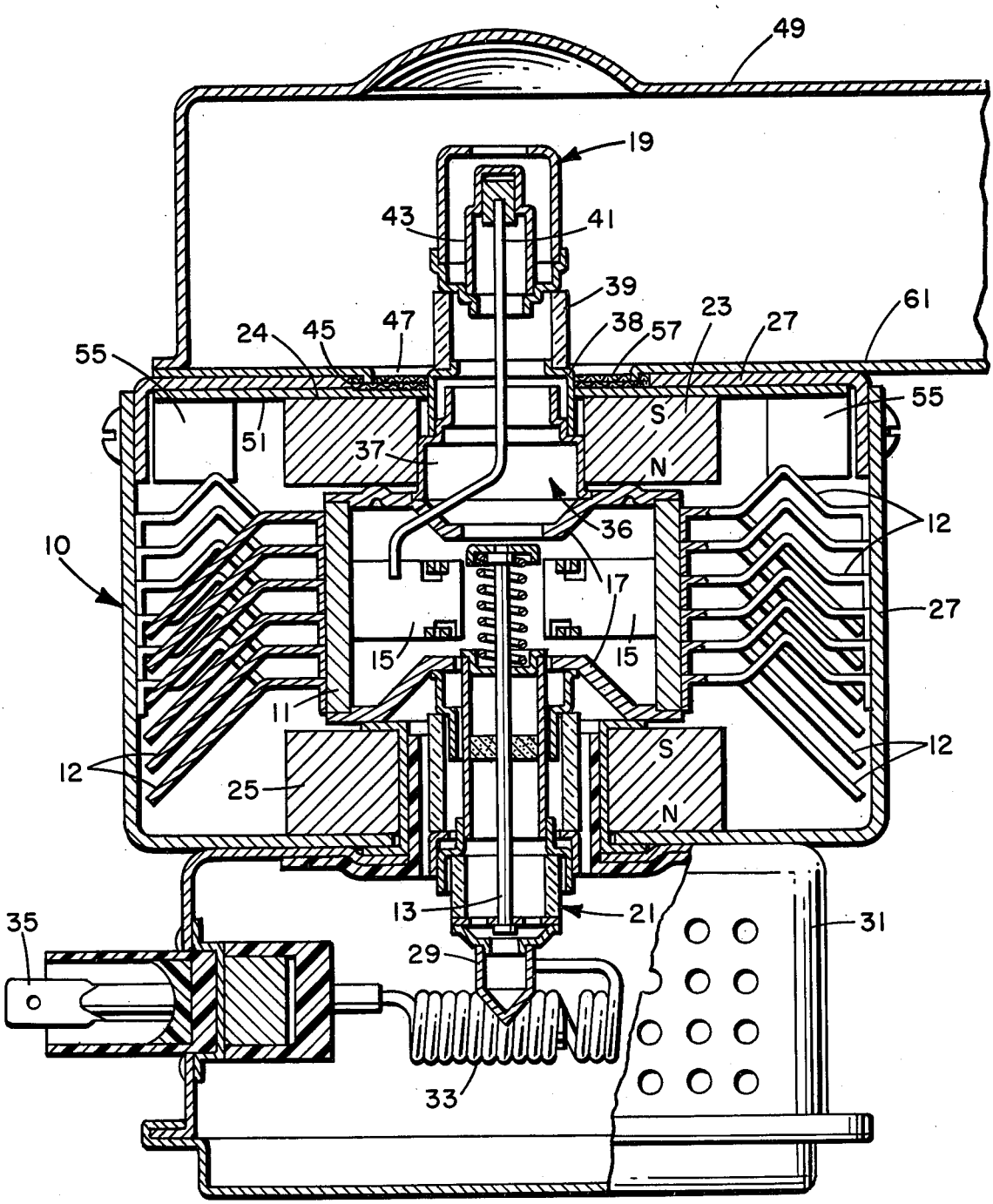
FIG. 1 is an axial sectional view of one embodiment of this invention.

Referring now to the drawings, wherein like reference numerals designate identical corresponding parts in each of the embodiments, FIGS. 1–5 show the magnetron of this invention. The magnetron 10 comprises a cylindrical anode 11 of copper and a cathode 13 positioned coaxially at the center of the anode 11.

On the inner wall of the anode 11, a plurality of vanes 15 are fixed to project radially to the center of the anode. The inner anode wall and the vanes 15 form a plurality of microwave cavities. Both end surfaces of the anode 11, that is, the top and bottom surfaces of anode 11 as illustrated in FIG. 1, are provided with funnel-shaped pole pieces 17. A plurality of cooling fins 12 are connected to the outer periphery of the anode 11.

An output or antenna portion 19 is extended axially from a surface of the anode 11 and an input or stem portion 21 is extended axially from another end surface of the anode 11. A pair of annular permanent magnets 23 and 25 of ferrite are secured to the opposite end surfaces of the anode 11. A yoke 27 surrounds the anode 11 and the magnets 23 and 25 so that the magnetic field generated by the magnets 23 and 25 is formed across the interaction space between the cathode 13 and vanes 15. The magnets 23 and 25, which are magnetized axially, form a magnetic circuit with the yoke 27.

The input portion 21 secures the cathode 13 on the axis of the anode 11 and supplies current to the cathode 13. An exhaust pipe 29 is attached to the end of the input portion 21. A shield box 31 is attached to the yoke 27 so as to enclose the input portion 21 to prevent undesired microwave radiation from the input portion 21. In the shield box 31, a choke coil 33 is connected between the input portion 21 and an input terminal 35 to choke microwave energy.

The output or antenna portion 19 comprises a metal cylinder 36 extending axially from the anode 11, a cylindrical insulator 39 and an antenna lead 41 extending through the metal cylinder 36 and the insulator 39. One end of the antenna lead 41 is attached to one of the vanes 15 and the other end is fixed to the insulator 39 by a sealing cap 43. The metal cylinder 36 is made from two cylinders 37 and 38. The upper end of the bottom cylinder 37 is reduced in diameter and inserted in the bottom of the top cylinder 38 to form a choke. The choke prevents the antenna portion 11 from radiating undesired harmonics. The metal cylinder 36 also can be a single part. The metal cylinder 36 forms a terminal which is coupled to the antenna lead 41. The output portion 19 extends through an opening of the annular permanent magnet 23 and an opening 45 of the yoke 27 and projects outwardly to radiate microwave energy.

Figure 2:
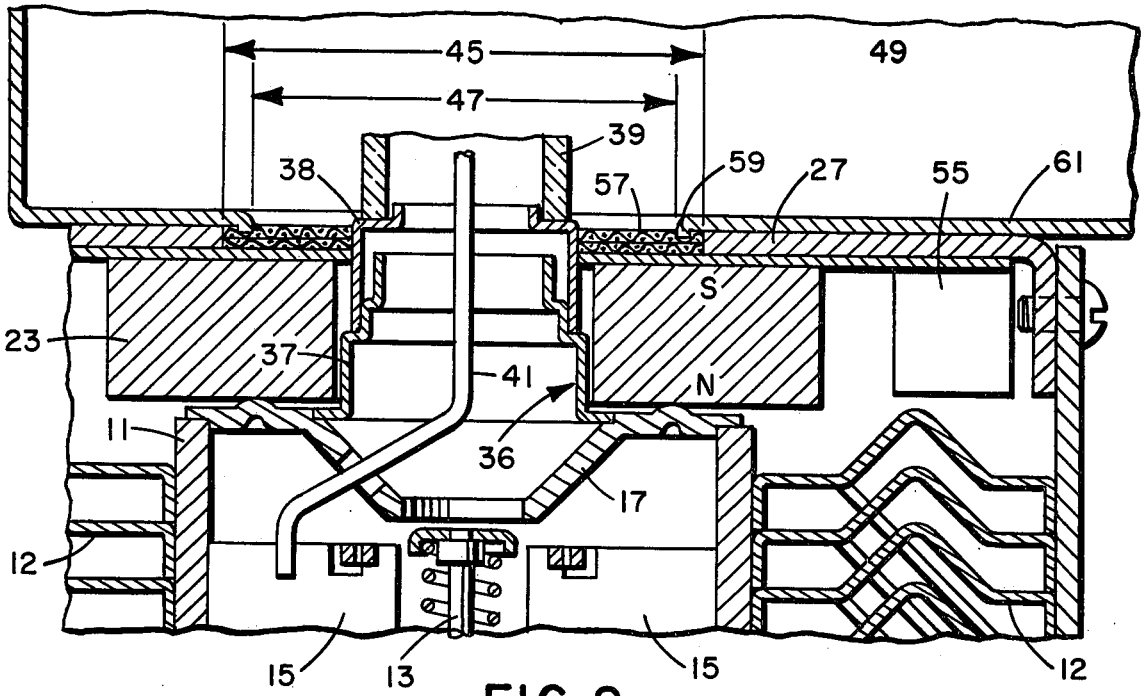
FIG. 2 is an enlarged sectional view of part of FIG. 1 showing the main portion of the magnetron.
Figure 3:
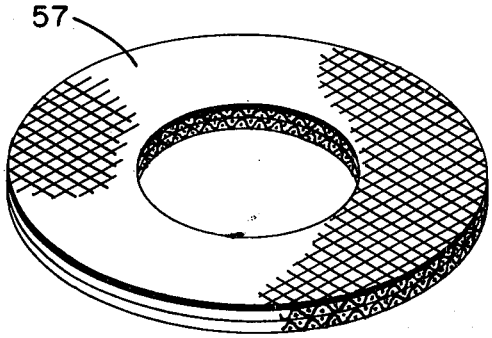
FIG. 3 is a perspective view of the gasket shown in FIG. 1.

The volume and outer diameter of the magnets 23 and 25 are smaller than the volume and outer diameter of magnets in conventional magnetrons. Consequently, the edge of the opening 45 of the yoke 27 is adjacent the outer portion of the magnet 23. The opening 45 of the yoke has a diameter slightly larger than the opening 47 of the outer device 49 as best illustrated in FIG. 2. The outer device 49 may be a microwave oven or a wave guide 49 as shown in FIG. 1.

The diameter of the opening 45 of the yoke 27 is greater than the inner diameter and less than the outer diameter of the magnet 23; it can be either substantially the same or larger than the center diameter of the magnet 23. The center radius, which is half the center diameter, is the distance along the top surface of the magnet 23 between the center of the magnet 23 and the center of the annular ring of magnet 23. In other words, the center radius extends along a radial line from the center of the magnet 23 to a point halfway the inner and outer radii of the annular ring of magnet 23.

Figure 4:
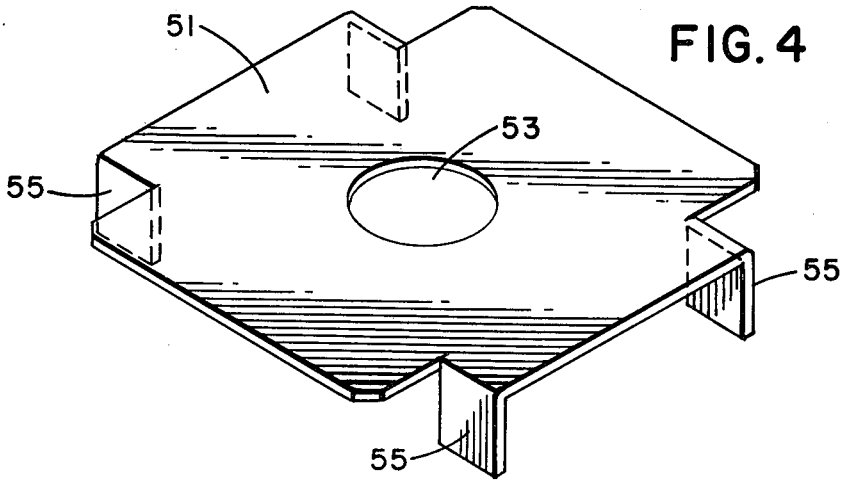
FIG. 4 is a perspective view of the magnetic shim plate shown in FIG. 1.

One whole end surface 24 of the magnet 23 facing the yoke 27 is covered by a magnetic shim plate 51. The end surface 24 and the yoke 27 are magnetically connected through the shin plate 51 without any gap between the magnet 23 and the yoke. The shim plate 51, which is best illustrated in FIG. 4, is a thin square plate of iron with an opening 53 at the center. Each corner of the shim plate 51 has a downwardly folded cooling fin 55 which is positioned at a right angle to the plate 51. These fins 55 control air flow through the inside of the yoke. An annular gasket 57 is disposed on the shim plate 51 between the metal cylinder 36 and the yoke 27. The gasket 57 contacts the metal cylinder 36, the shim plate 51 and the yoke 27. The gasket 57 is made of an elastic stacked metal wire net of high conductive metal such as copper or brass.

The wall 61 of the outer device 49 contacts the yoke 27. The wall 61 has an annular flange 59 around the opening 47. The flange 59, which projects slightly from the wall 61, presses into the gasket 57 to thereby make electrical contact.

In the embodiment of FIGS. 1–5, the shim plate 51 is made of ferromagnetic material so that it operates as an extension of the yoke 27. Consequently, the magnetic flux generated from one pole (S) of the magnet, i.e., the surface 24 facing the yoke, passes effectively over the yoke by means of the shim plate 51. The magnets 23 and 25 and the yoke 27 form a magnetic circuit which generates a magnetic field in the interaction space between anode vanes 15 and the cathode 13. The other pole of the magnet is designated (N). Thus, even though the opening of the yoke 27 has a larger diameter than the inner diameter of the magnet 23, the shim plate 51 prevents any reduction or fluctuation in the magnetic field.

Figure 6B:
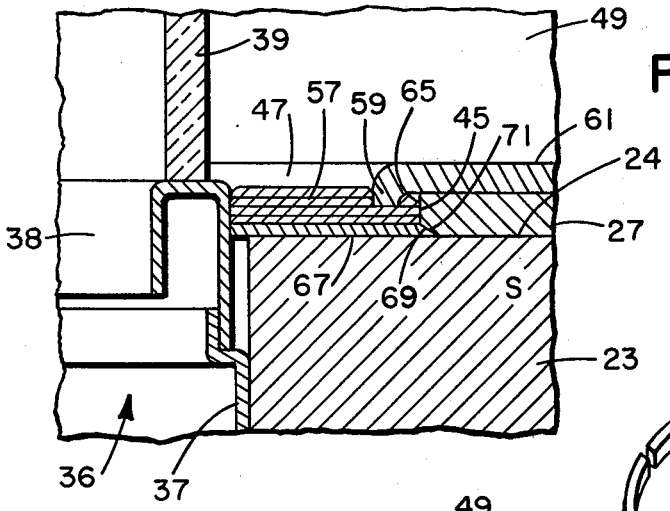

FIGS. 6A and 6B illustrates another embodiment. The edge 65 of the opening 45 of the yoke 27 is positioned substantially on the center of the annular ring of the magnet 23 as shown. An annular shim plate 67 is disposed on the magnet 23 between the cylinder 38 and the yoke 27. The shim plate 67 has an inner diameter equal to the outside diameter of the small cylinder 38 of the metal cylinder 36 and the outer diameter of the shim plate 67 is slightly larger than the opening 45 of the yoke 27. The shim plate 67 is made of a thin ferromagnetic plate. The outer edge 69 of the shim plate 67, which is wedge-shaped, fits in the beveled portion 71 around the edge 65. The shim plate 67 is fixed to the magnet 23. The result is that the whole surface 24 of the magnet 23 facing the yoke 27 contacts the yoke 27 and the shim page 67 without a gap. The magnetic flux from the surface 24 passes effectively through the yoke 27 via the shim plate 67 to prevent reduction and fluctuation of the magnetic flux. Fluctuation of the magnetic flux is furthermore prevented by the outer device 49.

Figure 8:
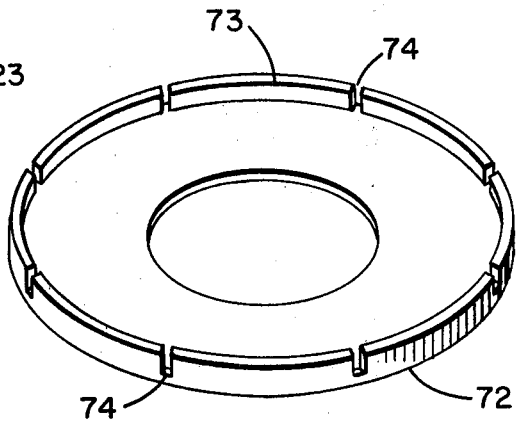
FIG. 8 is a perspective view of the magnetic shim plate shown in FIG. 7.
Figure 7:
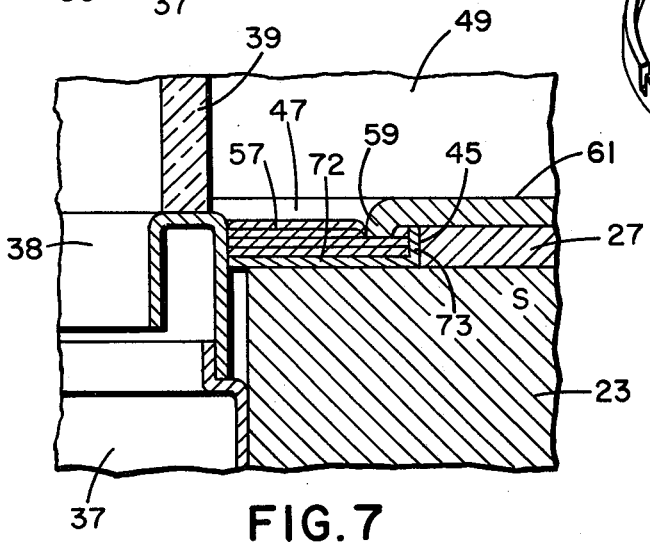
FIG. 7 is a sectional view similar to FIG. 6B showing of a modified form of the second embodiment of this invention.

A modified form of the embodiment of FIGS. 6A-6B of this invention is shown in FIG. 7 and FIG. 8. An annular ferromagnetic shim plate 72 is illustrated which has an annular flange 73 extending upwardly in the direction of the axis of the shim plate around the outer periphery thereof. The annular flange 73 has an outer diameter slightly larger than the opening 45 of the yoke 27 into which the flange 73 is firmly pressed.

The annular flange 73 also has a plurality of slits or notches 74 formed in a regular pattern around the flange to make magnetic contact with the yoke 27. The height of the annular flange 73 is substantially the same as the thickness of the yoke 27. Consequently, the magnetic conductivity between the yoke 27 and the shim plate 71 is enhanced. The gasket 57 is positioned on shim plate 72. When the magnetron is attached to the outer device 49, such as a microwave oven, the gasket 57 connects the metal cylinder 36 to the wall 61 of the outer device 49.

Figure 9:
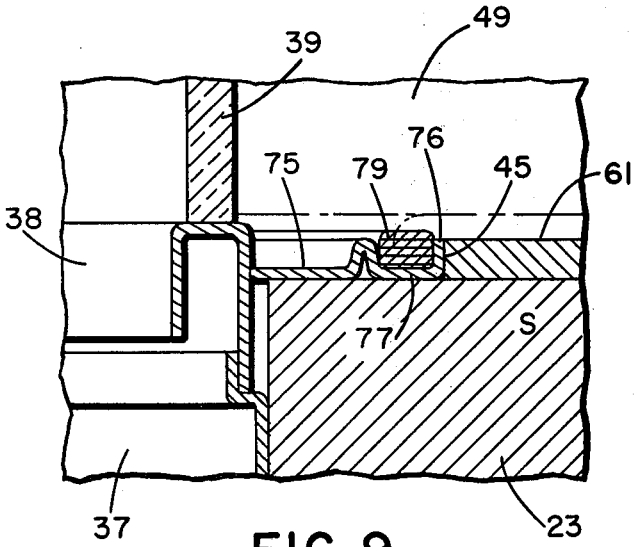
FIG. 9 is a sectional view similar to FIGS. 6B and 7 showing another modified form of the second embodiment of this invention.
Figure 10:
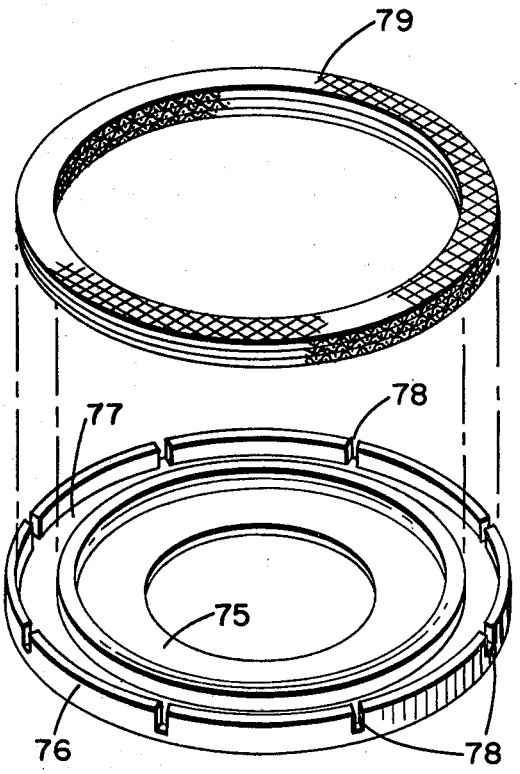
FIG. 10 is a perspective view of the gasket and the magnetic shim plate shown in FIG. 9.

Another modified form of the embodiment of FIGS. 6A-6B of this invention is shown in FIG. 9 and FIG. 10. An annular ferromagnetic shim plate 75 is formed with a groove 77 retaining a gasket 79. The outer annular flange 76 of plate 75 is provided with slits 78 to allow the shim plate to be pressed into opening 45. The bottom of the shim plate 75 contacts the magnet 23. The gasket 79 is connected electrically to the metal cylinder 36 by the shim plate 75. Consequently, the wall 61 of the outer device 49 is connected to the metal cylinder 36 through the gasket 79 and the shim plate 75. In this embodiment, a gasket having a small width can be used.

Figure 11:
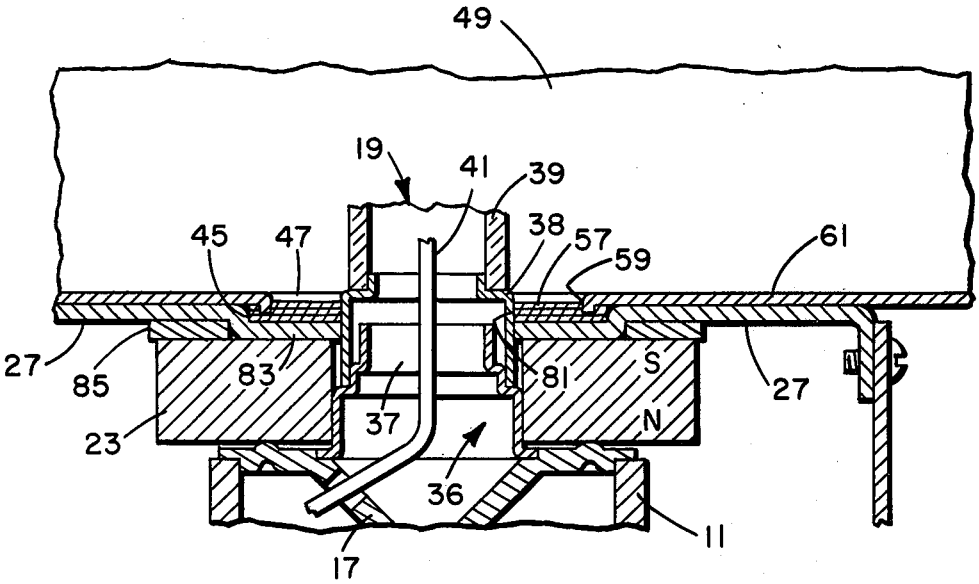
FIG. 11 is a sectional view of the main portion of a third embodiment of this invention.

FIG. 11 shows another embodiment of this invention. The output portion 19 extending from the anode 11 passes through the opening of the annular permanent magnet 23 and the opening 45 of the yoke 27 to project outside the yoke 27. Since a small sized magnetron having a short tube length is used, the length of the metal cylinder 36 is as short as possible. In this embodiment, the opening 81 of the yoke has practically the same diameter as the outer diameter of the top metal cylinder 38. An annular concave portion 83 is formed around the opening 81 of the yoke. The gasket 57 is positioned on the concave portion 83 and connected to the top metal cylinder 38. The bottom surface of the concave portion 83 contacts the inside portion of the surface of the magnet 23. An annular shim plate 85 is positioned between the yoke 27 and the remaining outside portion of the surface of the magnet 23. As a result, the whole surface of the magnet 23 facing the yoke makes magnetic contact with the yoke to thereby prevent the occurrance of any gap.

Figure 12:
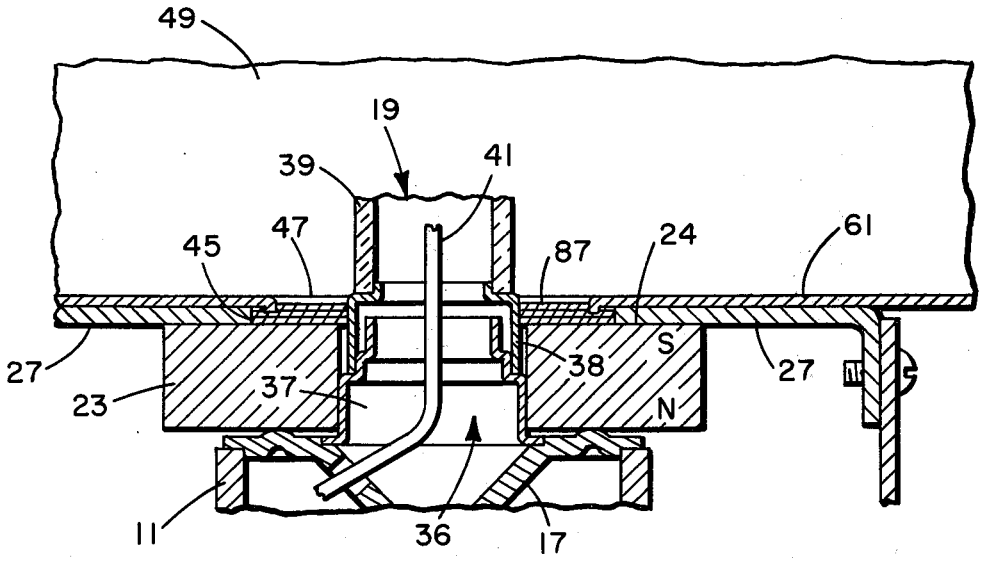
FIG. 12 is a sectional view of the main portion of a fourth embodiment of this invention.

In the embodiment shown in FIG. 12, the gasket 87 is an annular ferromagnetic cushion with multi-layers of knitted ferromagnetic metal wire such as soft iron. The gasket 87 is disposed directly on the upper surface 24 of the magnet 23 from the center of the annular ring. On the upper surface 24 from the center of the annular ring of the magnet 23, the yoke 27 makes direct contact. The gasket 87 is positioned between and makes contact with the top metal cylinder 38 and the edge of the opening 45 of the yoke 27. Since the gasket 87 is made of ferromagnetic material, the whole surface of the magnet 23 facing the yoke is covered with a magnetic layer. Consequently, magnetic flux from the magnet effectively flows through the yoke via the gasket 87. The gasket 87 may be plated with high electrical conductive metal such as gold, silver and copper so as to act as a conducting path between the metal cylinder 36 and the wall 61 of the outer device 49. In this embodiment, the gasket 87 functions like a shim plate.

As mentioned above, according to this invention, the whole surface of the magnet is in contact with the surface of the yoke, the shim plate, and the magnetic gasket. As a result, fluctuation and reduction of the magnetic flux from the magnet is prevented in spite of the large diameter of the opening 45 of the yoke. Also, the magnetic flux from the magnet is not effected by the outer device.

It is understood that this invention is not limited to the embodiments mentioned above. For example, this invention is applicable to an outer magnet type magnetron and a sealed envelope type magnetron as well as an inner magnet type magnetron. It is further understood that various modifications may be made in the shape of the magnets and the electrodes of the magnetron without departing from the scope and spirit of this invention. For example, the magnets need not be perfectly circular or annular and the anode need not be perfectly cylindrical since various shapes would be apparent to those of skill in the art.

I claim:

1. In a magnetron comprising:

a cylindrical anode having a plurality of vanes forming anode cavities;

a cathode positioned coaxially in said anode;

an output portion including a metal cylinder coupled to said anode;

An annular permanent magnet;

a yoke adjacent said permanent magnet to form a magnetic circuit therewith, said yoke having an opening through which said output portion extends, the diameter of said opening being greater than or substantially equal to the center diameter of said magnet; and a gasket positioned in said opening between said metal cylinder and said yoke, the improvement comprising a magnetic shim plate extending the entire length of said permanent magnet and positioned between said permanent magnet and said yoke, said magnetic shim plate being in contact with said permanent magnet to form a continuing magnetic circuit without any gaps.

2. The magnetron according to claim 1 wherein said gasket is positioned on said magnetic shim plate between the edge of said opening of said yoke and said metal cylinder.

3. In a magnetron comprising:

a cylindrical anode having a plurality of vanes forming anode cavities;

a cathode positioned coaxially in said anode;

an output portion including a metal cylinder coupled to said anode;

an annular permanent magnet;

a yoke adjacent said permanent magnet to form a magnetic circuit therewith, said yoke having an opening through which said output portion extends, the diameter of said opening being greater than or substantially equal to the center diameter of said magnet; and a gasket positioned in said opening between said metal cylinder and said yoke, the improvement comprising a magnetic shim plate extending the entire length of said permanent magnet and positioned between said permanent magnet and said yoke, said magnetic shim plate being in contact with said permanent magnet to form a continuing magnetic circuit without any gaps, said shim plate further including a cooling fin.

4. In a magnetron comprising:

a cylindrical anode having a plurality of vanes forming anode cavities a cathode positioned coaxially in said anode;

an output portion including a metal cylinder coupled to said anode;

an annular permanent magnet;

a yoke adjacent said permanent magnet to form a magnetic circuit therewith, said yoke having an opening through which said output portion extends, the diameter of said opening being greater than or substantially equal to the center diameter of said magnet; and a gasket positioned in said opening between said metal cylinder and said yoke, the improvement comprising a magnetic shim plate positioned on a inner portion of the surface of said annular permanent magnet facing said yoke, said inner portion extending at least from inner diameter to the center diameter of said annular permanent magnet, the outside edge of said magnetic shim plate and the remaining outer portion of the surface of said annular permanent magnet being in direct contact with said yoke to form a continuous magnetic circuit without any gaps along the entire surface of said annular permanent magnet.

5. In a magnetron comprising:

a cylinder anode having a plurality of vanes forming anode cavities;

a cathode positioned coaxially in said anode;

an output portion including a metal cylinder coupled to said anode;

an annular permanent magnet;

a yoke adjacent said permanent magnet to form a magnetic circuit therewith, said yoke having an opening through which said output portion extends, the diameter of said opening being greater than or substantially equal to the center diameter of said magnet; and a gasket positioned in said opening between said metal cylinder and said yoke, the improvement comprising a magnetic shim plate positioned on an inner portion of the surface of said annular permanent magnet facing said yoke, said inner portion extending at least from the inner diameter to the center diameter of said annular permanent magnet, the outside edge of said magnetic shim plate and the remaining outer portion of the surface of said annular permanent magnet being in direct contact with said yoke to form a continuous magnetic circuit without any gaps along the entire surface of said annular permanent magnet, the outside edge of said magnetic shim plate including an annular flange having a length substantially equal to the thickness of said yoke, said annular flange being in contact with the edge of said opening of said yoke.

6. The magnetron according to claim 5 wherein said annular flange has a plurality of notches.

7. The magnetron according to claim 4 wherein said magnetic shim plate has an annular groove and said gasket is positioned within said annular groove.

8. In a magnetron comprising:

a cylindrical anode;

a cathode positioned coaxially in said anode;

an output portion including a metal cylinder coupled to said anode;

an annular permanent magnet;

a yoke adjacent said permanent magnet to form a magnetic circuit therewith, said yoke having an opening through which said output portion extends; and a gasket positioned in said opening between said metal cylinder and said yoke, wherein the improvement comprises:

an annular concave portion on said yoke extending from said opening of said yoke to an outside edge having a diameter greater than or substantially equal to the center diameter of said annular permanent magnet, said annular concave portion being in contact with said annular permanent magnet, said gasket being positioned in said annular concave portion in contact with said metal cylinder; and a magnetic shim plate positioned outside said annular concave portion and between said permanent magnet and said yoke to form a continuous magnetic circuit without any gaps.

9. In a magnetron comprising:

a cylindrical anode;

a cathode positioned coaxially in said anode;

an output portion comprising a metal cylinder coupled to said anode;

an annular permanent magnet;

a yoke adjacent said permanent magnet to form a magnetic circuit therewith, said yoke having an opening through which said output portion extends, the diameter of said opening being greater than or substanially equal to the center diameter of said magnet; and a gasket positioned in said opening, wherein the improvement comprises an annular elastic gasket made of magnetic material positioned on said permanent magnet between said metal cylinder and said yoke, said annular elastic gasket being in contact with said permanent magnet to form a continuous magnetic circuit between said permanent magnet and said yoke.

* * * * *